US008104204B1

(12) United States Patent
Syrstad

(10) Patent No.: US 8,104,204 B1
(45) Date of Patent: Jan. 31, 2012

(54) ELECTRONIC SIGN HAVING VERTICALLY HINGED FACE PANEL DOORS

(75) Inventor: John W. Syrstad, Rutland, SD (US)

(73) Assignee: Daktronics, Inc., Brookings, SD (US)

( * ) Notice: Subject to any disclaimer, the term of this patent is extended or adjusted under 35 U.S.C. 154(b) by 1159 days.

(21) Appl. No.: 11/897,198

(22) Filed: Aug. 29, 2007

(51) Int. Cl.
*G09F 13/04* (2006.01)
*G09F 13/22* (2006.01)

(52) U.S. Cl. ..... 40/573; 40/544

(58) Field of Classification Search ..... 40/544, 40/579, 564, 568, 573, 574; 16/363, 374; 312/138.1, 324, 326, 329, 109
See application file for complete search history.

(56) References Cited

U.S. PATENT DOCUMENTS

| | | | | |
|---|---|---|---|---|
| 2,053,547 | A | 9/1936 | Austin | |
| 2,987,782 | A * | 6/1961 | Kurowski | 49/386 |
| 2,998,667 | A * | 9/1961 | Darnell et al. | 40/564 |
| 3,291,975 | A | 12/1966 | Mccullough et al. | |
| 3,310,901 | A | 3/1967 | Sarkisian | |
| 3,594,761 | A | 7/1971 | Boesen | |
| 4,234,914 | A | 11/1980 | Boesen | |
| 4,364,616 | A * | 12/1982 | Harkins et al. | 40/568 |
| 5,172,504 | A | 12/1992 | De Maat et al. | |
| 5,268,828 | A | 12/1993 | Miura | |
| 5,321,417 | A | 6/1994 | Voelzke et al. | |
| 5,410,328 | A | 4/1995 | Yoksza et al. | |
| 5,647,152 | A | 7/1997 | Miura | |
| 5,692,855 | A | 12/1997 | Burton | |
| 5,715,619 | A | 2/1998 | Polisois et al. | |
| 6,154,945 | A | 12/2000 | Voelzke | |
| 6,169,632 | B1 | 1/2001 | Kurtenbach et al. | |
| 6,267,421 | B1 * | 7/2001 | Burton | 292/340 |
| 6,314,669 | B1 | 11/2001 | Tucker | |
| 6,508,494 | B1 | 1/2003 | Reuter et al. | |
| D482,403 | S | 11/2003 | Rose | |
| 6,677,918 | B2 | 1/2004 | Yuhara et al. | |

(Continued)

FOREIGN PATENT DOCUMENTS

JP 8-140023 A 5/1996

(Continued)

OTHER PUBLICATIONS

"European Application Serial No. 08165444.4, European Search Report mailed Mar. 4, 2009", 9 pgs.

*Primary Examiner* — Joanne Silbermann
(74) *Attorney, Agent, or Firm* — Schwegman, Lundberg & Woessner P.A.

(57) ABSTRACT

An electronic sign having vertically hinged face panel doors which open individually about offset hinge assemblies and which aid in minimizing distorted seal compression. Individual door stop assemblies allow an operator to manageably open the face panel doors and to lock the face panel doors. In the open position, the face panel doors are protected from damage due to wind currents or gusts. The use of face panel doors having a parallelogram cross section profile allows for closely spaced face panel doors with a minimum panel-to-panel gap for uniform spacing and viewing of lighted pixel displays.

23 Claims, 14 Drawing Sheets

U.S. PATENT DOCUMENTS

| | | | |
|---|---|---|---|
| 6,729,054 | B1 | 5/2004 | VanderTuin |
| 6,741,222 | B1 | 5/2004 | Tucker |
| 6,813,853 | B1 | 11/2004 | Tucker |
| 7,071,620 | B2 | 7/2006 | Devos et al. |
| 7,091,933 | B2 | 8/2006 | McClintock et al. |
| 7,373,747 | B1 | 5/2008 | Wiemer et al. |
| 7,448,154 | B1 | 11/2008 | Kludt |
| 7,605,772 | B2 | 10/2009 | Syrstad |
| 7,694,444 | B2 | 4/2010 | Miller et al. |
| 2002/0093799 | A1 | 7/2002 | Federer et al. |
| 2003/0217495 | A1 | 11/2003 | Nagamine et al. |
| 2004/0104871 | A1 | 6/2004 | Boldt et al. |
| 2006/0090384 | A1* | 5/2006 | Woodruff ..... 40/544 |
| 2008/0060234 | A1 | 3/2008 | Chou |

FOREIGN PATENT DOCUMENTS

| | | | |
|---|---|---|---|
| JP | 11-265153 | A | 9/1999 |
| JP | 2001-350434 | A | 12/2001 |

* cited by examiner

ELECTRONIC SIGN HAVING VERTICALLY HINGED FACE PANEL DOORS

CROSS REFERENCES TO RELATED APPLICATIONS

This patent application is related to patent application Ser. No. 11/227,599 filed Sep. 15, 2005, entitled "Electronic Display Panel," which is pending and which is a continuation-in-part of patent application Ser. No. 11/148,461 filed Jun. 9, 2005, entitled "Sign System," which is pending.

This patent application is also related to patent application Ser. No. 11/809,107 filed May 31, 2007, entitled "Electronic Sign Having A Formed Metal Cabinet," which is pending.

BACKGROUND OF THE INVENTION

1. Field of the Invention

The present invention is for an electronic sign, and more specifically, is for an electronic sign having vertically face panel doors.

2. Description of the Prior Art

Most existing prior art front access full matrix signage used large single panel top hinged lift face panels that were ungainly and awkward to open and close, difficult to seal against the elements, insects and the like, as well as involving an inordinate amount of time to gain access thereinto. Another concern is for the safety of technicians where support of a horizontally attached large heavy panel over the area where technicians are working on the display can be in danger if the support structural integrity is compromised. Other prior art devices used displays with multiple vertically hinged doors, but the pixels spacing at the vertical seams between doors was excessive due to large gaps between panels that allowed the doors to pivot open without incurring mutual door interference at adjacent door edges. Weather sealing provided by this design was very poor as the weather seals were small and thin in order to promote close juxtaposition of pixels from door-to-door.

Other prior art devices used horizontal panels that only allowed for partial (line) LED matrix to be displayed. Because of the space required for hinges and brackets between the panels, full matrix displays larger then a few feet tall were not possible.

Other prior art devices utilized a panel the size of the whole display face that was horizontally hinged across the top which, because of shear size, was difficult to properly weather seal. The large size of panel also required the use of gas shocks and/or several technicians to aid in lifting the panel out of place for access. Such a device also typically used a large piece of polycarbonate sheet across the entire face of the viewing area. In the present invention, the large piece of polycarbonate sheet is replaced by smaller pieces behind the multiple viewing hole face sheet but in front of the LED (light emitting diode) modules in each of the manageable multiple vertically hinged face panel doors. If a face panel is damaged by a projectile or in some other manner, it can be easier and more cost effective to repair a smaller face panel component compared to repair or placement of a much larger face panel.

Other signage using vertical hinges included large gaps in the LED matrix due to the interceding projecting structure of the hinge hardware. These gaps forced the pixel pitch to increase noticeably between face panels on all but the largest pixel pitches. These gaps were used so that the adjacent face panels could open and close without interference. The present invention overcomes such a problem by the suitable placement of the hinge pivot axis and by the use of face panel doors having parallelogram cross sections in order that a very minimal gap can be used.

The present invention allows for a quick, easy and safe way to access the sign, to seal the sign, and to provide for continuous viewing of LED pixels made possible by minimum sized gaps between adjacent LED display matrixes.

SUMMARY OF THE INVENTION

The general purpose of the present invention is to provide an electronic sign having vertically hinged face panel doors.

The invention is an electronic sign having vertically hinged face panel doors which allow for easy access to the inside of the sign from the front by the opening of one or more manageable vertically hinged face panel doors instead of one large and heavy face panel. Structure is provided to allow for a full matrix display where the face panel seams do not prevent the pixel spacing from being uniform across the broad matrix of the sign.

Another important aspect of the face panel door design is the parallelogram shape of the cross section as viewed from above. The horizontally aligned parallelogram shaped top panel (and bottom panel) of the face panel doors are in an angled relationship with respect to the vertically aligned and opposed side panels of the configured face panel doors. Such angled alignment provides ability for the face panel doors to open and close without any physical interference with neighboring face panel doors and, when closed, to form a very small gap between the face panels of adjacent face panel doors. Any face panel door can be opened and closed independently and without difficulty regardless of whether neighboring face panel doors are open or closed.

The face panel doors have upper and lower hinge bracket assemblies that place the vertically aligned pivot axis slightly forward of the face panel door and to the one side of the face panel door. The hinge bracket assemblies are placed so that the face panel doors can pivot without interference with each other. The position of the hinge pivot axis is also important in that it allows the foam weather seal to be compressed at as close to an optimal angle as possible. Ideally, a flexible weather seal should be compressed as close to straight on as possible. This is achieved by making the angle between the plane of the seal and the plane of the hinge bracket assemblies as close to zero as possible. The pivot point assemblies are placed as close to the face sheet and as far as possible to one side while still allowing the panels to operate without physical interference.

Door stop assemblies are another very important feature of the present invention. When the face panel doors open to 90 degrees they are automatically and securely held in position by a gravity activated door stop assembly consisting of opposed mirror image-like slotted track channels at the top and bottom of the frame slidingly connected to and linked to the face panel door by opposed horizontally oriented cross bar links. A handle in the form of a vertically aligned link bar attaches to both cross bar links wherein the components can operatively function as a single system. The linkage bar handle enables an individual to operate the door stop assembly components connected to an individual face panel door from any associated location within a partially open position. The door stop assemblies hold the face panel doors securely so that the face panel doors' other components of the invention sign can be serviced safely, even under windy conditions, thereby preventing inadvertent rotation of the face panel doors and thus preventing injury to service personnel.

According to one or more illustrations of the present invention, there is provided an electronic sign having a frame, a plurality of vertically hinged face panel doors secured to the frame, a plurality of offset hinge assemblies securing the hinged face panel doors to the frame, a door stop assembly attached between the plurality of face panel doors and the frame, robust captivated bolt door latches secured to the upper and lower forward regions of the face panel doors and door catches secured to the upper and lower forward regions of the frame. Also included in the face panel doors are vertically aligned spacers, LED display modules and a protective polycarbonate sheet.

One significant aspect and feature of the present invention is the use of vertically hinged face panel doors allowing front access while still maintaining a full matrix LED display without visual interference by hinges.

Another significant aspect and feature of the present invention is a structure which allows a single person to safely open the face panel door or doors without mechanical assistance.

Still another significant aspect and feature of the present invention is that the electronic sign is more easily serviced because the face panel doors are lightweight individual structures which can be easily manipulated by one person.

Still another significant aspect and feature of the present invention is the ability to display full, line, and partial matrix displays.

Yet another significant aspect and feature of the present invention is that there are no noticeable gaps in the pixel distribution.

Yet another significant aspect and feature of the present invention is the parallelogram profile of the access door when viewed from the top.

Yet another significant aspect and feature of the present invention is the ability to handle increased wind loads because the doors can be built with a deep enough depth to add extra support members.

Still another significant aspect and feature of the present invention is the use of individual polycarbonate sheets placed between the face panel and the LED display modules in order that smaller door sections can be used in the display.

Yet another significant aspect and feature of the present invention is the use of top and bottom latches in each door having rugged captivated bolt latches for durability.

Still another significant aspect and feature of the present invention is the use of door stops which keep the wind from moving a face panel door when it is open.

Yet another significant aspect and feature of the present invention is the placement of the door hinges that provide the proper motion of the face panel doors so that the weather seal becomes properly sealed.

Having thus briefly described embodiments of the present invention and having mentioned some significant aspects and features of the present invention, it is the principal object of the present invention to provide an electronic sign having vertically hinged face panel doors.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
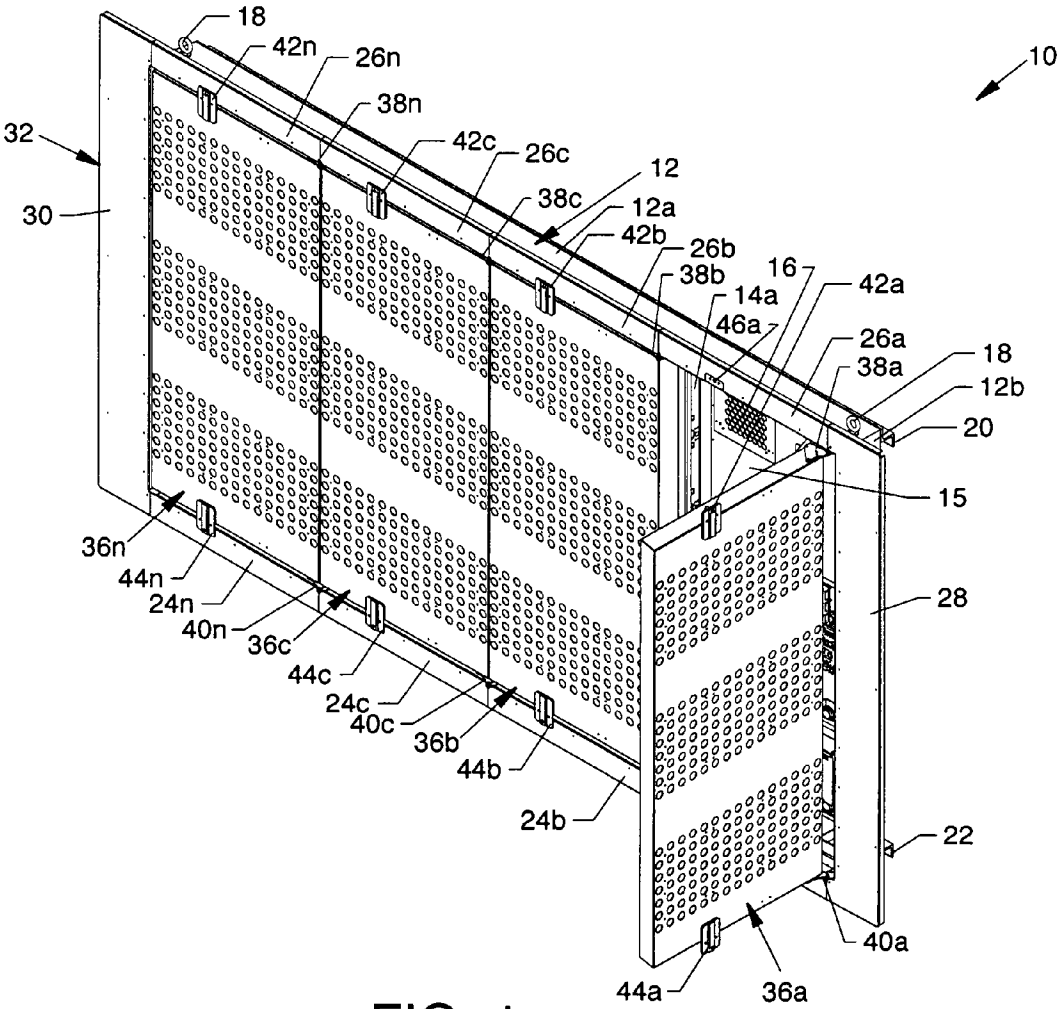
FIG. 1 is an isometric view of an electronic sign having vertically hinged face panel doors, the present invention.
Figure 2:
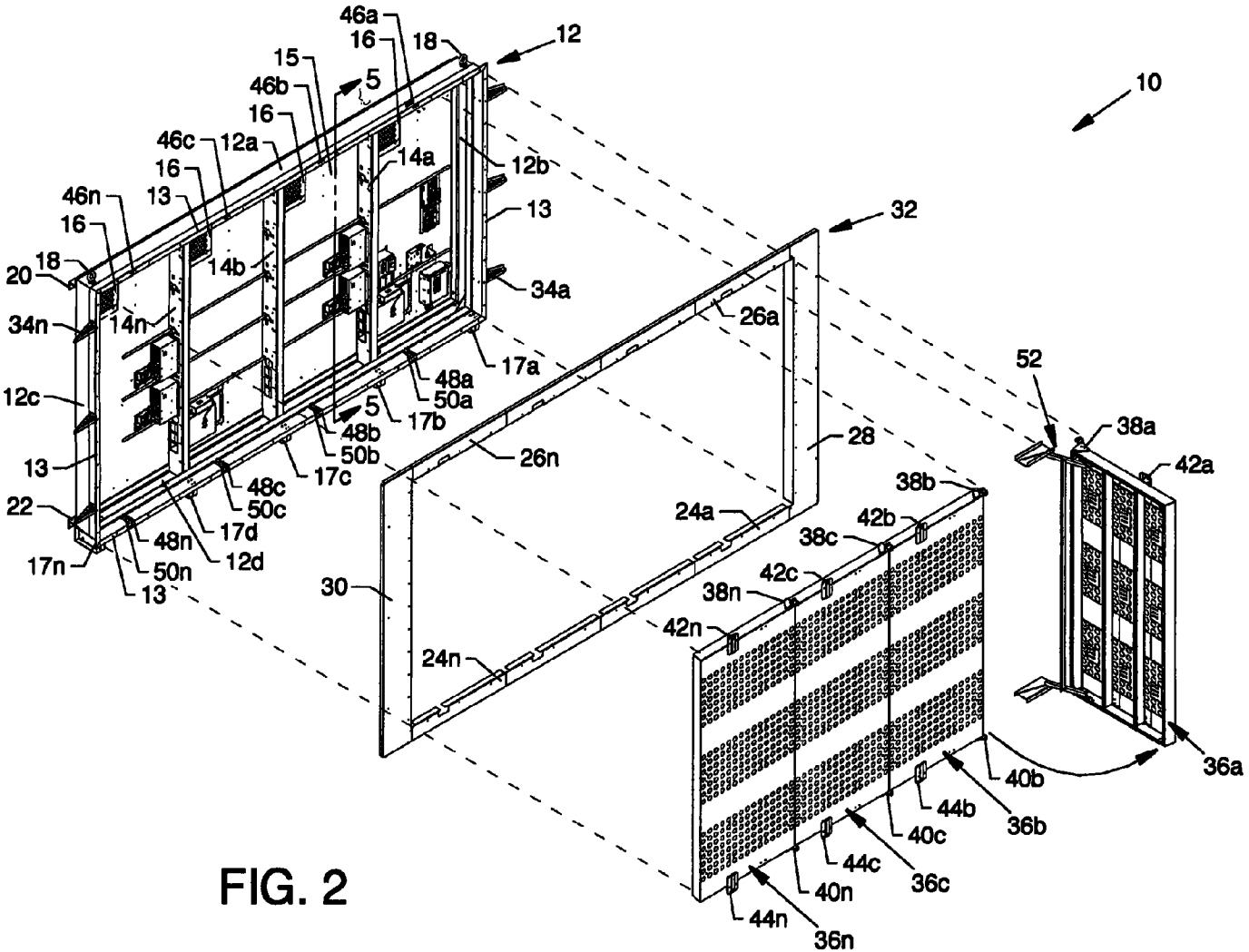
FIG. 2 is a semi-exploded isometric view of the components of FIGS. 1, 3 and 4.
Figure 3:
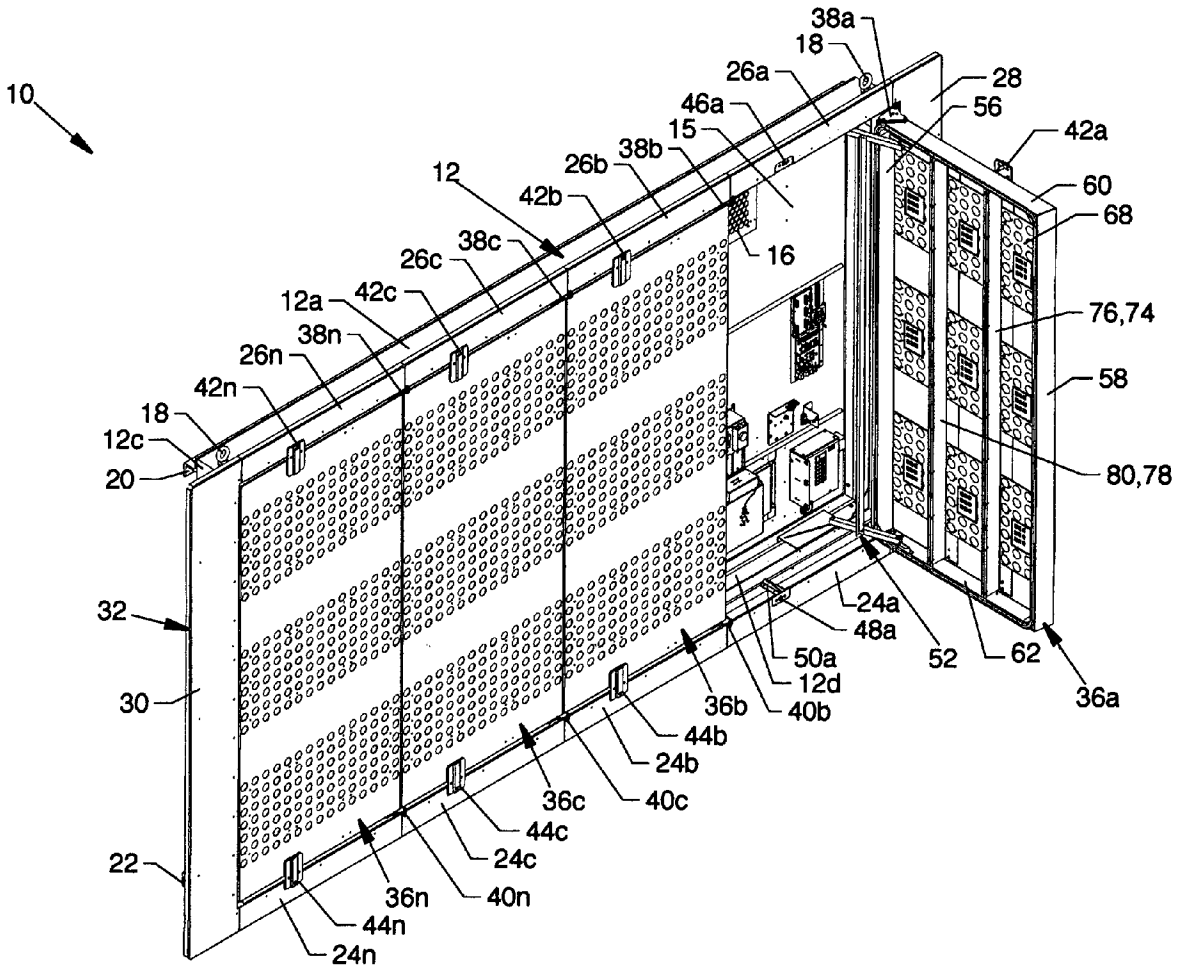
FIG. 3 is an isometric view of an electronic sign having vertically hinged face panel doors.
Figure 4:
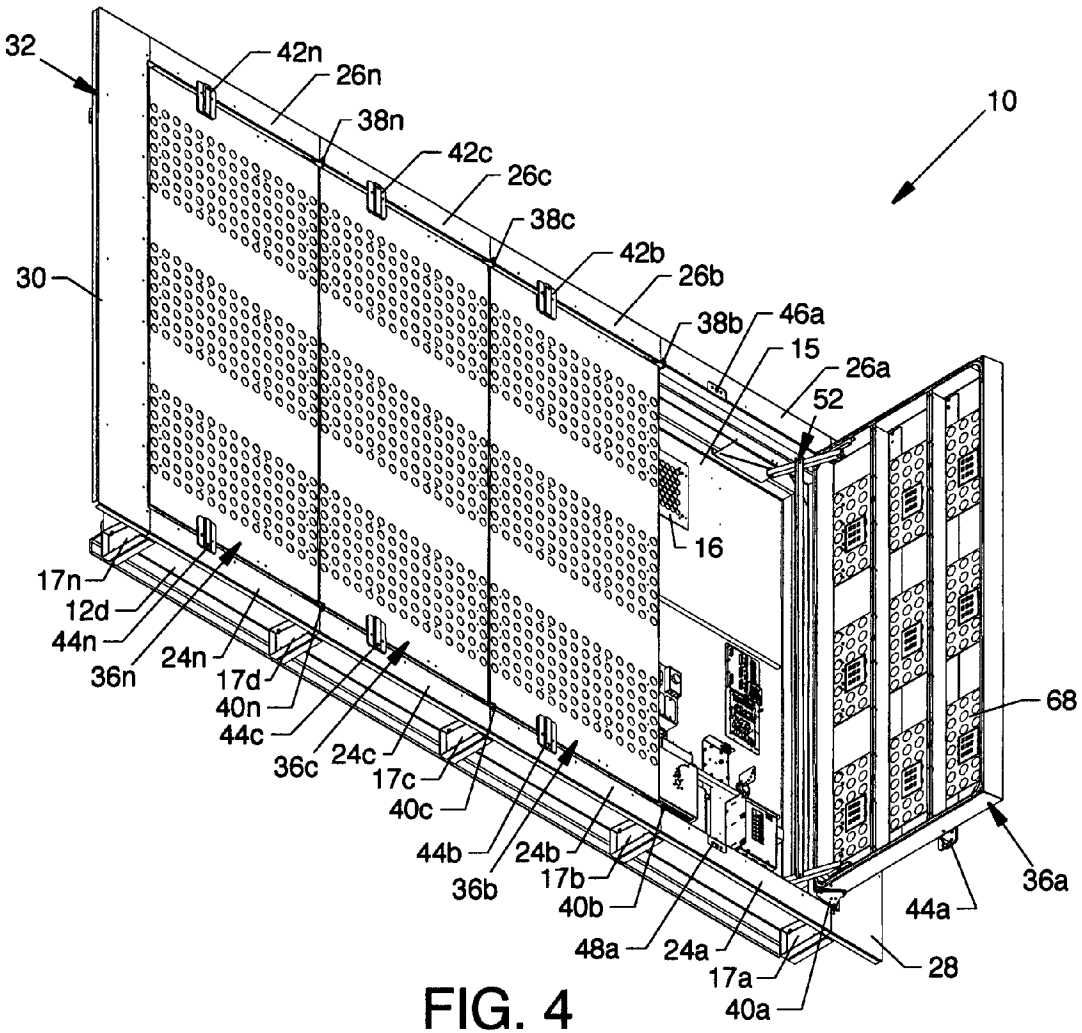
FIG. 4 is another isometric view of an electronic sign having vertically hinged face panel doors.
Figure 5:
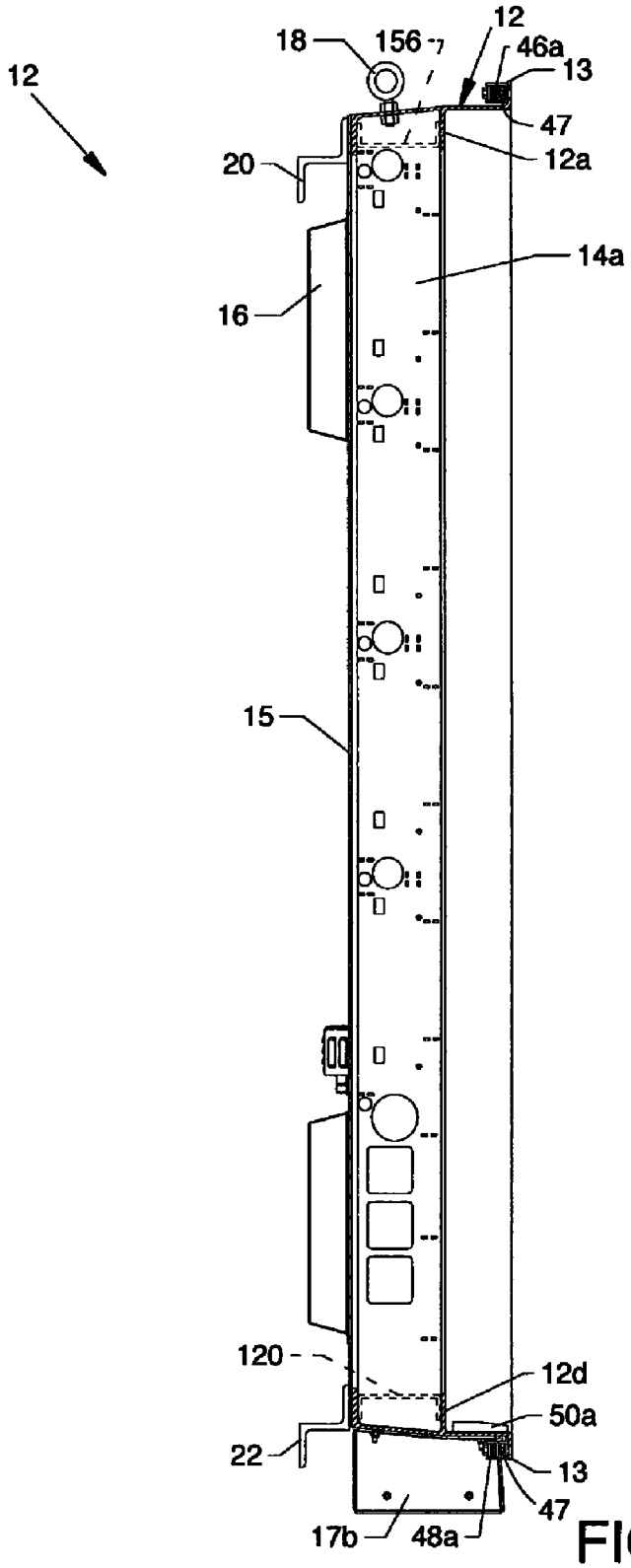
FIG. 5 is a vertical cross section view through the frame along line 5-5 of FIG. 2.

FIGS. 1, 3 and 4 are isometric views of an electronic sign 10 having vertically hinged face panel doors 36*a*-36*n*. FIG. 2 is a semi-exploded isometric view of the components of FIGS. 1, 3 and 4. FIG. 5 is a vertical cross section view through the frame 12 shown in FIGS. 1, 2, 3 and 4 through line 5-5 of FIG. 2. With reference to FIGS. 3, 4 and 5, and especially to FIGS. 1 and 2, fully or partially illustrated components of the invention are now described. The frame 12, to which multiple components are aligned and secured, includes configured channels including a top channel 12*a*, opposed end channels 12*b* and 12*c*, and a bottom channel 12*d*. A continuous lip 13 is formed by vertically aligned portions of the top channel 12*a*, opposed end channels 12*b* and 12*c*, and the bottom channel 12*d*. A plurality of vertically aligned formed channels 14*a*-14*n*, referenced in pending patent application Ser. No. 11/809,107 entitled "Electronic Sign Having a Formed Metal Cabinet" filed May 31, 2007, extend and are secured between the top channel 12*a* and the bottom channel 12*d* to provide for support between the top channel 12*a* and the bottom channel 12*d* and to serve partially as a mounting structure for a back panel 15. The back panel 15, which accommodates electronic circuitry and which has multiple vents 16, is secured to the rear perimeter of the frame 12. A plurality of vertically aligned bottom supports 17*a*-17*n* is secured to the bottom of the bottom channel 12*d*. Lifting lugs 18 are secured to the frame 12. Mounting brackets 20 and 22 are aligned over the back panel 15 and are secured to the perimeter of the frame 12.

A plurality of lower and upper lipped panels 24*a*-24*n* and 26*a*-26*n*, respectively, is aligned between the ends of lipped panels 28 and 30 and are combined to form a facia panel 32. The inwardly extending interior lips of each lower and upper lipped panels 24*a*-24*n* and 26*a*-26*n* and of the end lipped panels 28 and 30 are aligned and are secured to the inner perimeter of the frame 12; i.e., to the top channel 12*a*, opposed end channels 12*b* and 12*c*, and the bottom channel 12*d*, respectively. The outwardly located vertically aligned main panel portions of the lower and upper lipped panels 24*a*-24*n* and 26*a*-26*n*, respectively, and of the end lipped panels 28 and 30 are aligned and are secured to the continuous lip 13 located at the forward perimeter of the frame 12. A plurality of supports 34*a*-34*n* is distributed and secured to the end channels 12*b* and 12*c* of the frame 12 in order to provide additional support for the end lipped panels 28 and 30 of the facia panel 32. Thus, the facia panel 32 is secured to the frame 12.

The upper portion of a plurality of similarly constructed face panel doors 36*a*-36*n* are hinged and rotatingly secured to the top channel 12*a* of the frame 12 by the use of a plurality of top hinge bracket assemblies 38*a*-38*n* and the lower portion of the plurality of face panel doors 36*a*-36*n* are hinged and rotatingly secured to the bottom channel 12*d* of the frame 12 by the use of a plurality of bottom hinge bracket assemblies 40*a*-40*n*. A plurality of robust and rugged top latch assemblies 42*a*-42*n* is distanced from the top hinge bracket assemblies 38*a*-38*n* along the plurality of face panel doors 36*a*-36*n* and suitably secured to the upper front of the face panel doors 36*a*-36*n*. A plurality of bottom latch assemblies 44*a*-44*n* is distanced from the bottom hinge bracket assemblies 40*a*-40*n* along the plurality of face panel doors 36*a*-36*n* and suitably secured to the lower front of the face panel doors 36*a*-36*n*. When the face panel doors 36*a*-36*n* are in the closed position, the top latch assemblies 42*a*-42*n* and the bottom latch assemblies 44*a*-44*n* are aligned with a plurality of top catch assemblies 46*a*-46*n* and a plurality of bottom catch assemblies 48*a*-48*n* located in the top channel 12*a* and the bottom channel 12*d*, respectively, in order that mutual engagement therewith can be effected. A plurality of ramped guides 50*a*-50*n* is located on an upper surface of the bottom channel 12*d* to ensure suitable vertical clearance of the bottom of the face panel doors 36*a*-36*n*, respectively. A plurality of door stop assemblies, such as door stop assembly 52, as described later in detail, is included between each of the face panel doors 36*a*-36*n* and the bottom and top channels 12*d* and 12*a*, such as shown by the door stop assembly 52 at the hinged side of the face panel door 36*a* in FIG. 2.

FIG. 5 is a vertical cross section view through the frame 12 along line 5-5 of FIG. 2 showing the alignment of the formed channel 14*a* between the top channel 12*a* and the bottom channel 12*d*. For the purpose of brevity and clarity, the electronic components are not shown. Also shown are the bottom slotted track channel 120 and the top slotted track channel 156 of the door stop assembly 52 (FIGS. 3 and 4) secured and aligned within the top channel 12*a* and the bottom channel 12*d*, respectively.

Figure 6:
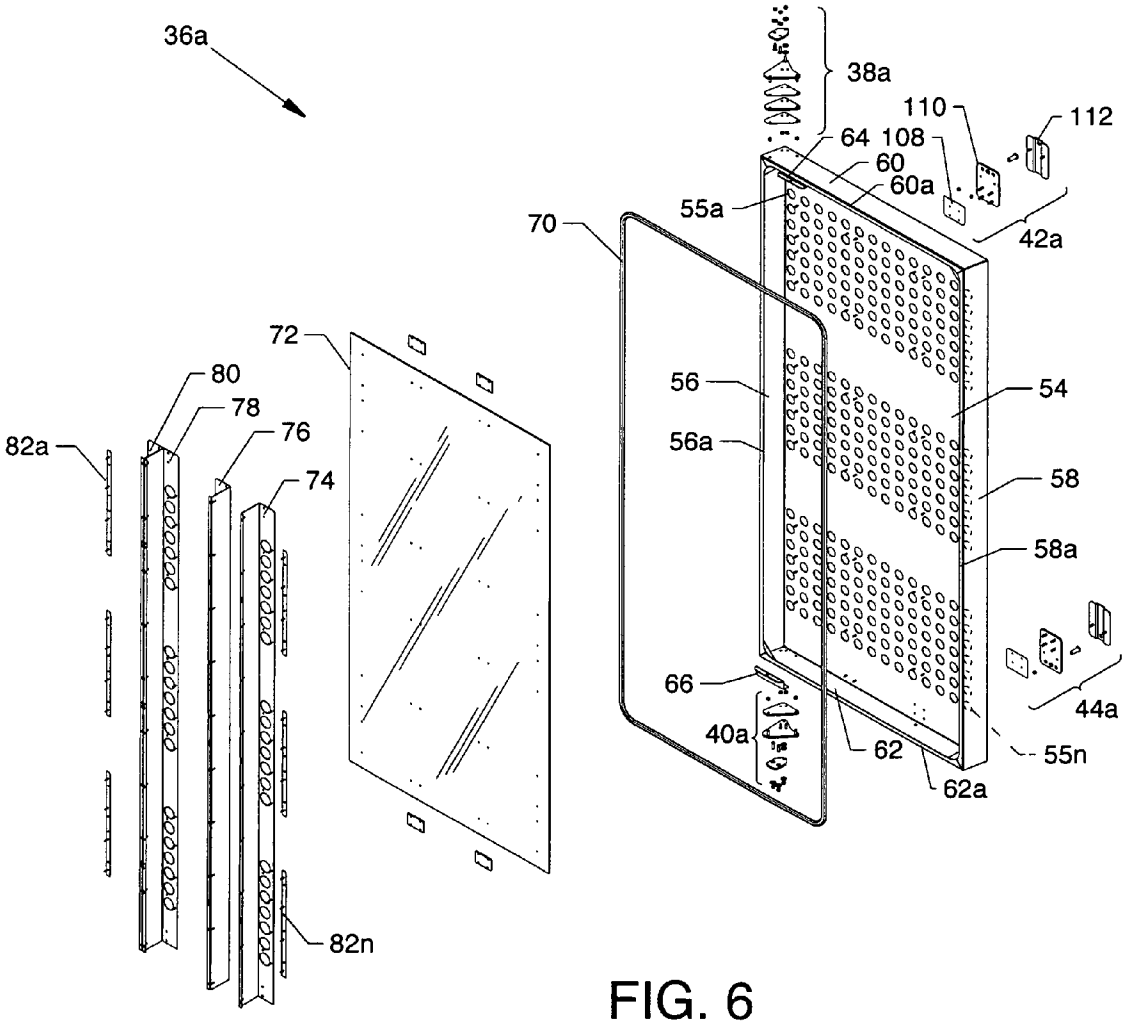
FIG. 6 is an exploded view of a face panel door.
Figure 13:
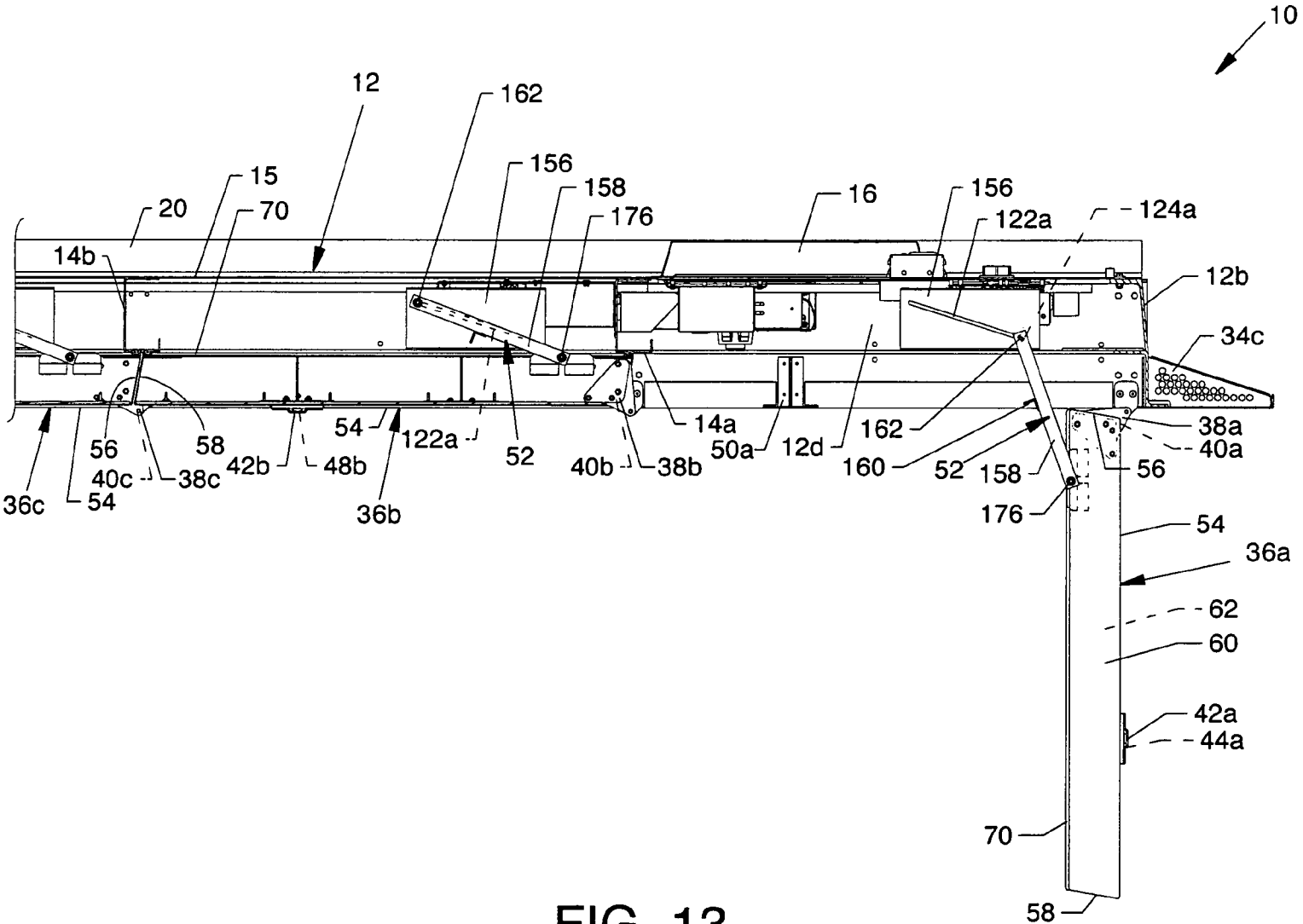
FIG. 13 is a top view of several face panel doors or portions thereof secured to a frame; and, FIGS. 14*a* and 14*b* illustrate the operation of the door stop assembly.

FIG. 6 is an exploded view of the face panel door 36*a* which is closely related to the face panel door disclosed in patent application Ser. No. 11/227,599 filed Sep. 15, 2005, entitled "Electronic Display Panel," presently pending. The face panel door 36*a* is substantially a one-piece structure having a face panel 54 and opposed side panels 56 and 58 and opposed parallelogram shaped top and bottom panels 60 and 62, respectively, which are formed at various angles extending inwardly from the face panel 54 the top view of which is shown in FIG. 13. The face panel 54 includes a plurality of holes 55*a*-55*n* for viewing of LED pixels located on LED display modules 68 (FIG. 3) The opposed side panels 56 and 58 and opposed top panels 60 and 62 include rearwardly located lips 56*a*, 58*a*, 60*a* and 62*a*, respectively, at the rearward portion thereof. The lips 56*a*, 58*a*, 60*a* and 62*a* are parallel to the face panel 54. Other components of the face panel door 36*a* include the top hinge bracket assembly 38*a* attached to the top surface at one end of the top panel 60 and the bottom hinge bracket assembly 40*a* attached to the bottom surface at one end of the bottom panel 62. Also attached to the underside of the top panel 60 in close proximity to the top hinge bracket assembly 38*a* is a top pivot bracket 64, and attached to the upper side of the bottom panel 62 in close proximity to the bottom hinge bracket assembly 40*a* is a similarly structured bottom pivot bracket 66, where such pivot brackets 64 and 66 are components of the face panel door 36*a* which are used to interface between the face panel door 36*a* and the door stop assembly 52. Other components of the face panel door 36*a* include the top latch assembly 42*a* attached to the upper forward facing surface of the face panel 54 and the bottom latch assembly 44*a* attached to the lower forward facing surface of the face panel 54. Another component of the front panel doors 36*a*-36*n* is a seal 70, preferably of foam or soft rubber or plastic, having a broad base and a low profile for minimum compression distortion which seal 70 is secured to the rearwardly located lips 56*a*, 58*a*, 60*a* and 62*a* for subsequent sealing of the front panel doors 36*a*-36*n* upon closure with structures, such as, but not limited to, portions of the top channel 12*a*, the bottom channel 12*d*, the end channels 12*b* and 12*c*, and portions of the formed channels 14*a*-14*n*, respectively. Another component of the front panel doors 36*a*-36*n* is a polycarbonate panel 72, preferably clear and having hardware accommodation holes, which panel 72 is aligned and secured over rearwardly extending hardware and mates to the rear surface of the face panel 54. Mirror image configured spacers 74 and 76 (shown separated) and spacers 78 and 80, shown in intimate contact, are also aligned and secured to the rear of the polycarbonate sheet 72 and over the rearwardly extending hardware of the face panel 54, as do a plurality of vertically aligned plates 82*a* 82*n* where such components are part of the face panel doors 36*a*-36*n*.

Figure 7:
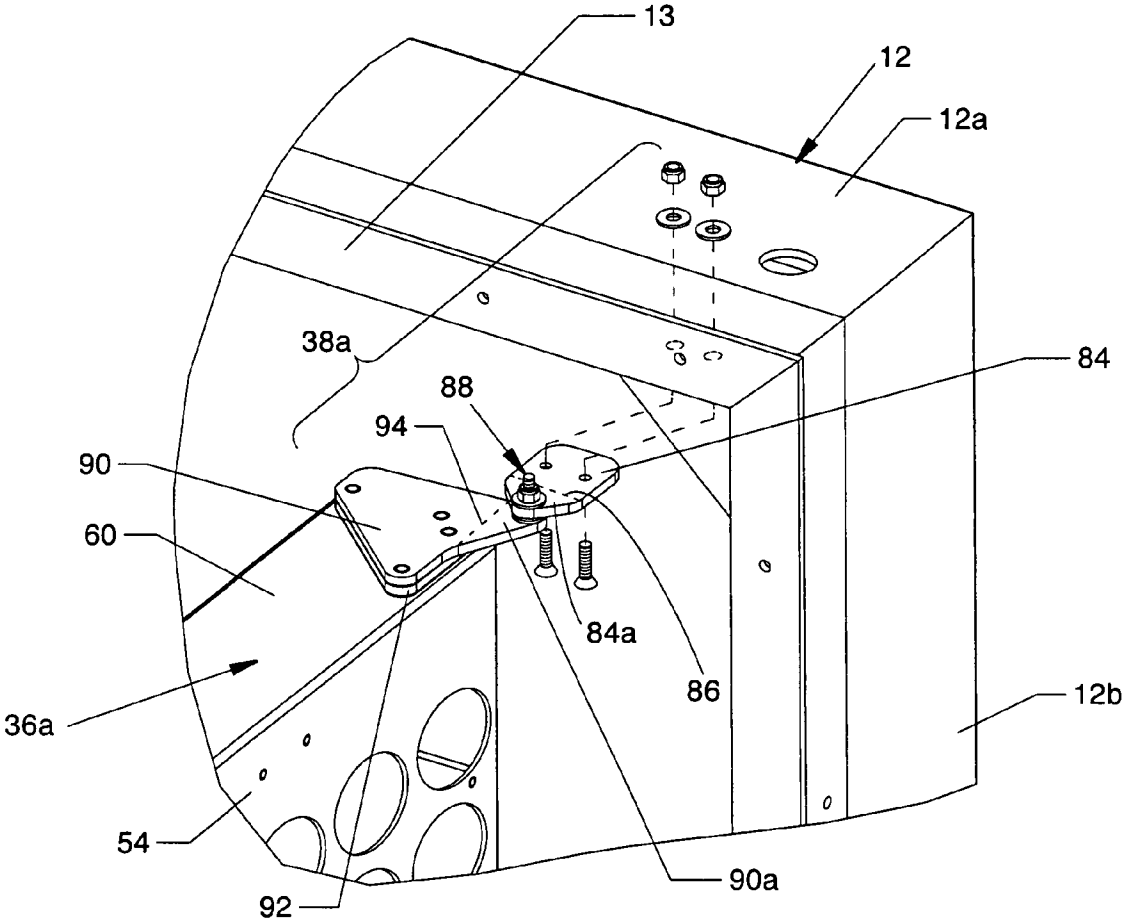
FIGS. 7 and 8 are segmented isometric views showing the attachment of a top hinge bracket assembly to a top panel of the face panel door and of the attachment of a bottom hinge bracket assembly to the bottom panel of the face panel door.
Figure 8:
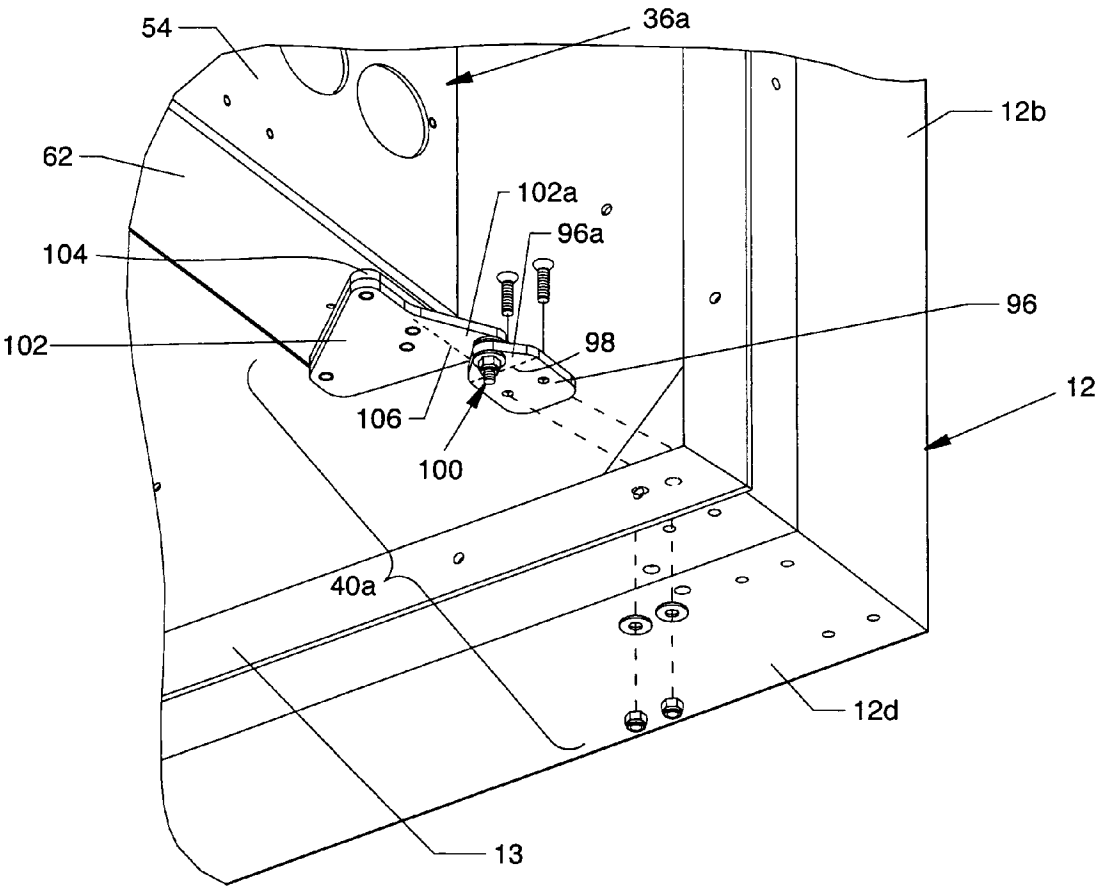

FIGS. 7 and 8 are isometric views showing the attachment of the top hinge bracket assembly 38*a* to the top panel 60 of the face panel door 36*a* and of the attachment of the bottom hinge bracket assembly 40*a* to the bottom panel 62 of the face panel door 36*a*, respectively. In FIG. 7, one hinge bracket 84 secures to the top channel 12*a* of the frame 12 with suitable fasteners in conjunction with body holes extending through the top channel 12*a* and the hinge bracket 84. Part of the hinge bracket 84 designated as extension 84*a* extending forward of a reference line 86 on the hinge bracket 84 accommodates part of a vertically oriented pivot assembly 88 extending therethrough. The extension 84*a* of the hinge bracket 84 extending in front of the reference line 86 extends outwardly beyond the upper lipped panel 26*a* of the facia panel 32 (not shown), as well as outwardly and forwardly of the continuous lip 13 in order to provide a suitable spacing for near straight-on compression (as opposed to sliding and deformed contact compression) of the seal 70 when the face panel door 36*a* in a closed position. The top hinge bracket assembly 38*a* also includes another hinge bracket 90 and a plurality of underlying spacers 92 secured to the top panel 60 of the face panel door 36*a* with suitable fasteners in conjunction with body holes extending through the hinge bracket 90, the plurality of underlying spacers 92, and the top panel 60. Part of the hinge bracket 90 designated as extension 90*a* extending forward of a reference line 94 on the hinge bracket 90 accommodates part of the vertically oriented pivot assembly 88 extending therethrough. The extension 90*a* of the hinge bracket 90 extending in front of the reference line 94 extends outwardly beyond the upper lipped panel 26*a* of the facia panel 32 (not shown), as well as outwardly and forwardly of the continuous lip 13 in order to provide a suitable spacing for near straight-on compression as possible (as opposed to sliding and deformed contact compression) of the seal 70 when the face panel door 36*a* is in a closed position.

FIG. 8 is an isometric view showing the attachment of the bottom hinge bracket assembly 40*a* to the bottom panel 62 of the face panel door 36*a* in mirror fashion and in the same manner as described for attachment of the top hinge bracket assembly 38*a* to the top panel 60 of the face panel door 36*a*, as described in FIG. 7. Corresponding like components or references including a hinge bracket 96, an extension 96*a*, a reference line 98, a pivot assembly 100, a hinge bracket 102, an extension 102*a*, a plurality of spacers 104, and a reference line 106 are associatingly attached and/or associated therewith and reflect similar teachings, attributes and relationships as described in FIG. 7.

Figure 9:
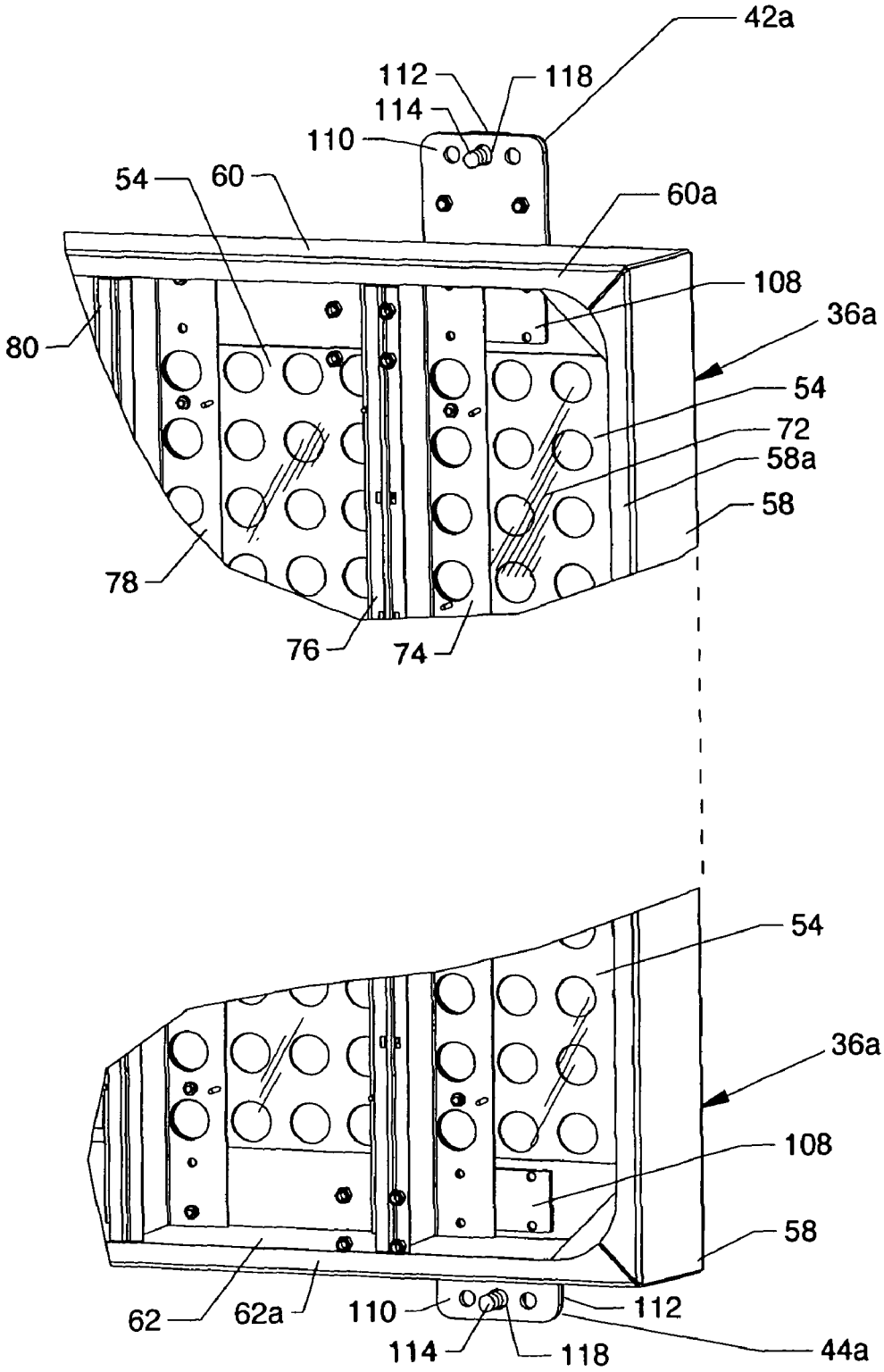
FIG. 9 is a segmented isometric view showing the top latch assembly secured to the front of the face panel adjacent to the top panel of the face panel door and, correspondingly, of the bottom latch assembly secured to the front of the face panel adjacent to the bottom panel of the face panel door.
Figure 10:
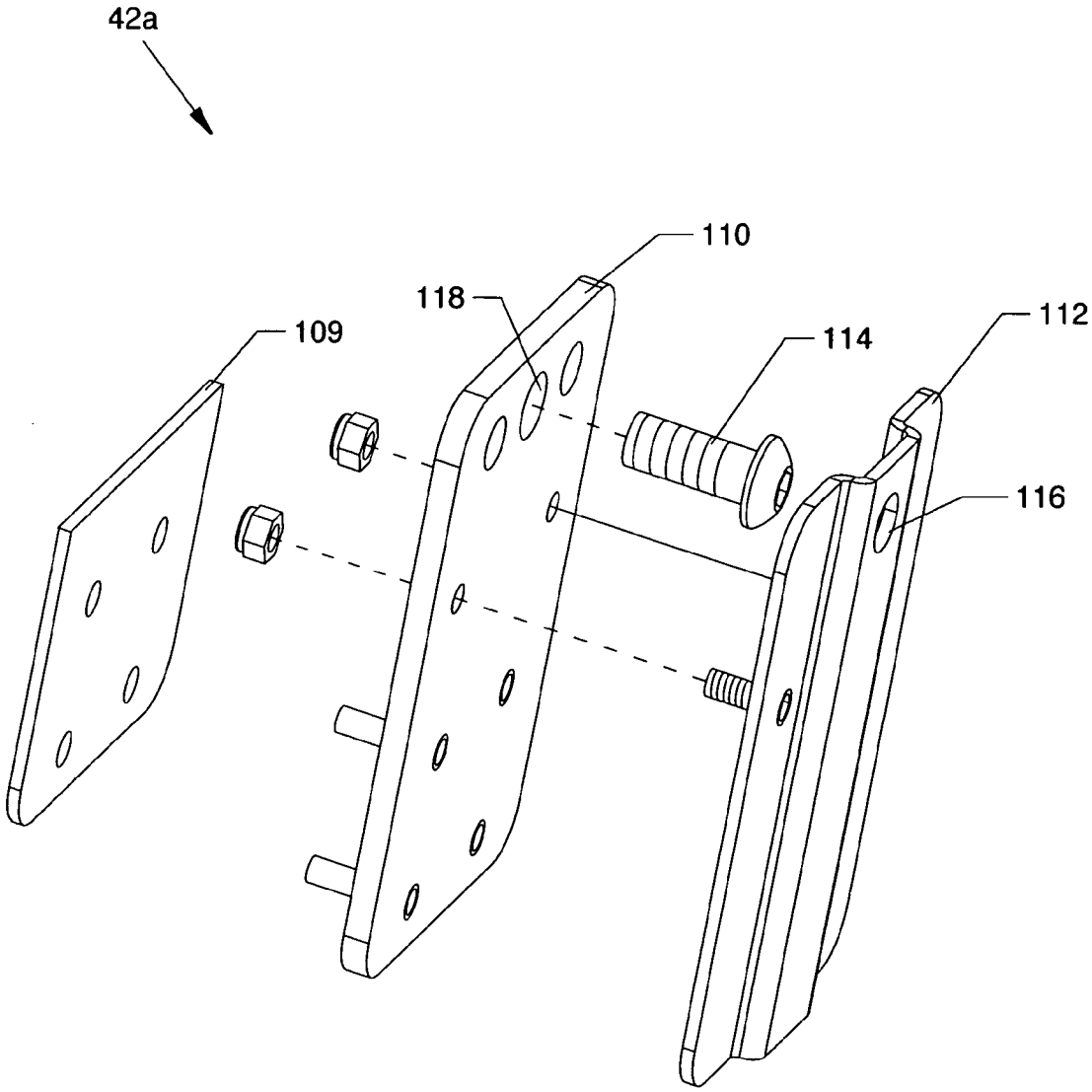
FIG. 10 is an exploded view of the structure of a top latch assembly.

FIG. 9 is a segmented isometric view showing a top latch assembly 42*a* secured to the front of the face panel 54 adjacent the top panel 60 of the face panel door 36*a* and, correspondingly, of the bottom latch assembly 44*a* secured to the front of the face panel 54 adjacent the bottom panel 62 of the face panel door 36*a*. Inner spacer gaskets 108 are also shown opposite the top and bottom latch assemblies 42*a* and 44*a* at the rear of face panel 54. With additional reference to FIG. 10, structure of the top latch assembly 42*a* is shown in exploded view including a gasket 109 which is aligned with the front of the face panel 54 and other components which are attached substantially to or which are located in front of or in general association with the front region of the face panel 54, including an outer plate 110, a channel plate 112, and a fastener 114, such as a machine screw or bolt, preferably with a hex head or other configured security head, which extends through a body hole 118 in the outer plate 110. The channel plate 112 captivates the fastener 114 in the body hole 118 in the outer plate 110. The features of the head of the fastener 114 are accessible through an access hole 116 in the channel plate 112 in order to facilitate engagement of the fastener 114 with threaded surfaces, such as in a captured nut 47 (FIG. 5) in the top catch assembly 46*a*. Suitable hardware mutually secures the top latch assembly 42*a* components, as well as providing means for attachment of the top latch assembly 42*a* to the face panel 54. Correspondingly, the bottom latch assembly 44*a* is comprised of like components and is in mirror image-like orientation with respect to the top latch assembly 42*a*.

Figure 11:
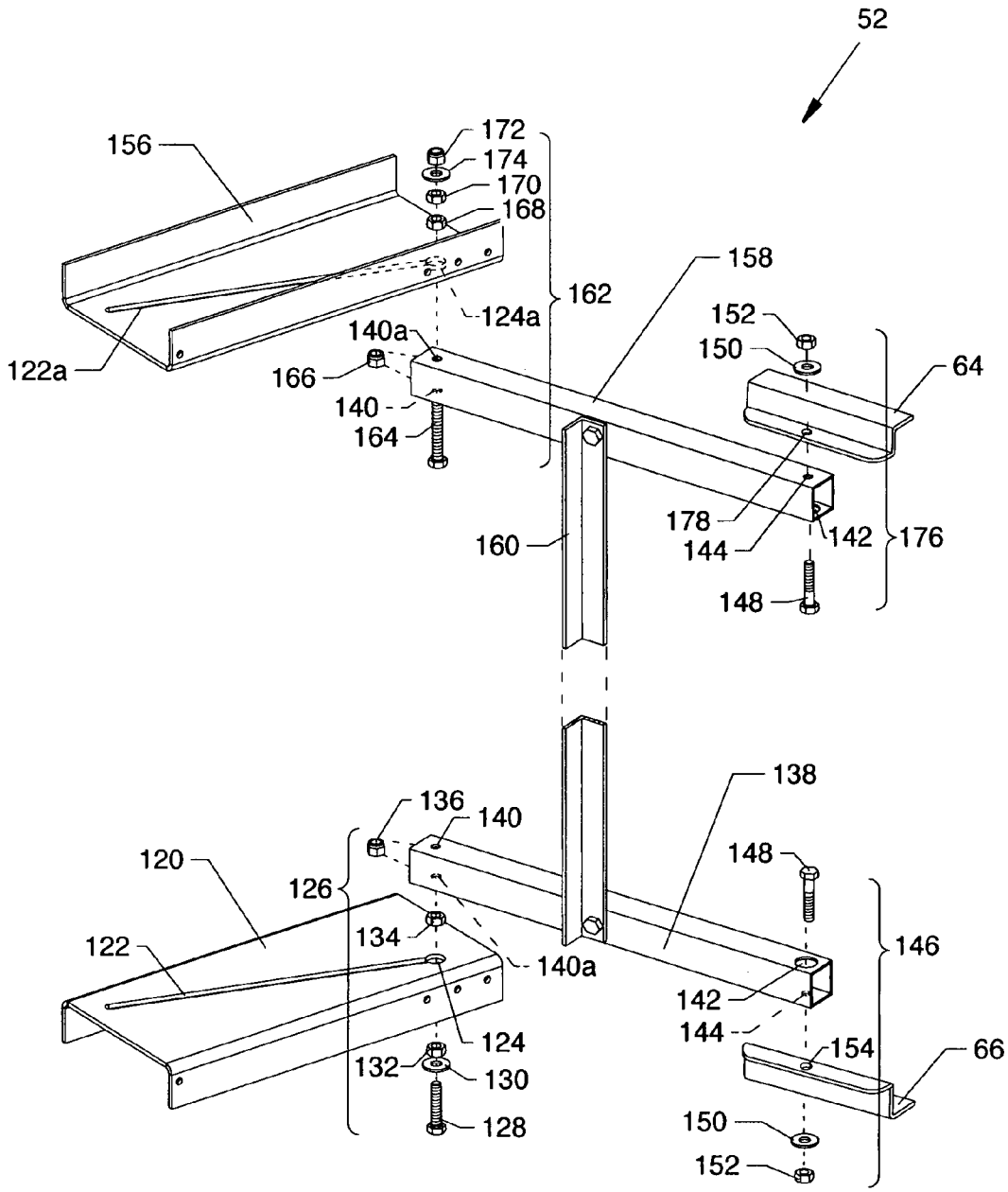
FIG. 11 is a foreshortened isometric view of the door stop assembly used to lock the face panel doors in the open position.
Figure 12:
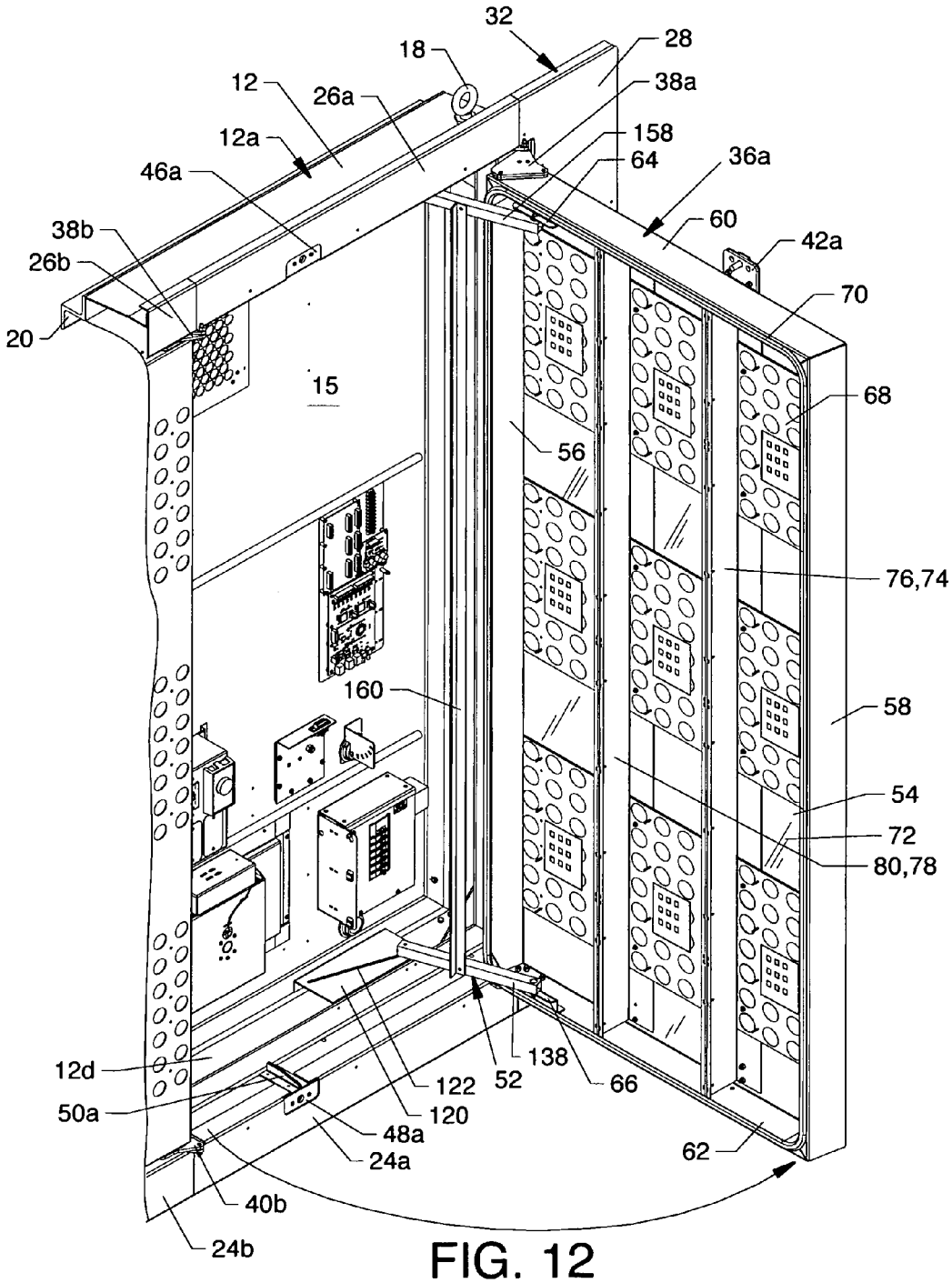
FIG. 12 illustrates the door stop assembly in use to hold a face panel door in the open position.
Figure 14B:
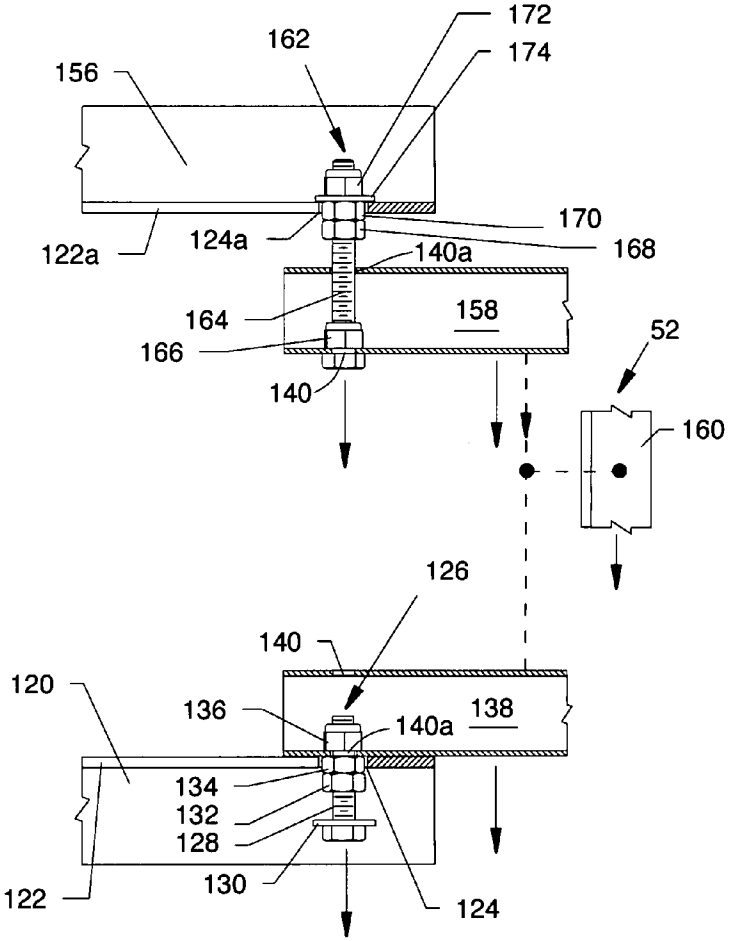
Figure 14A:
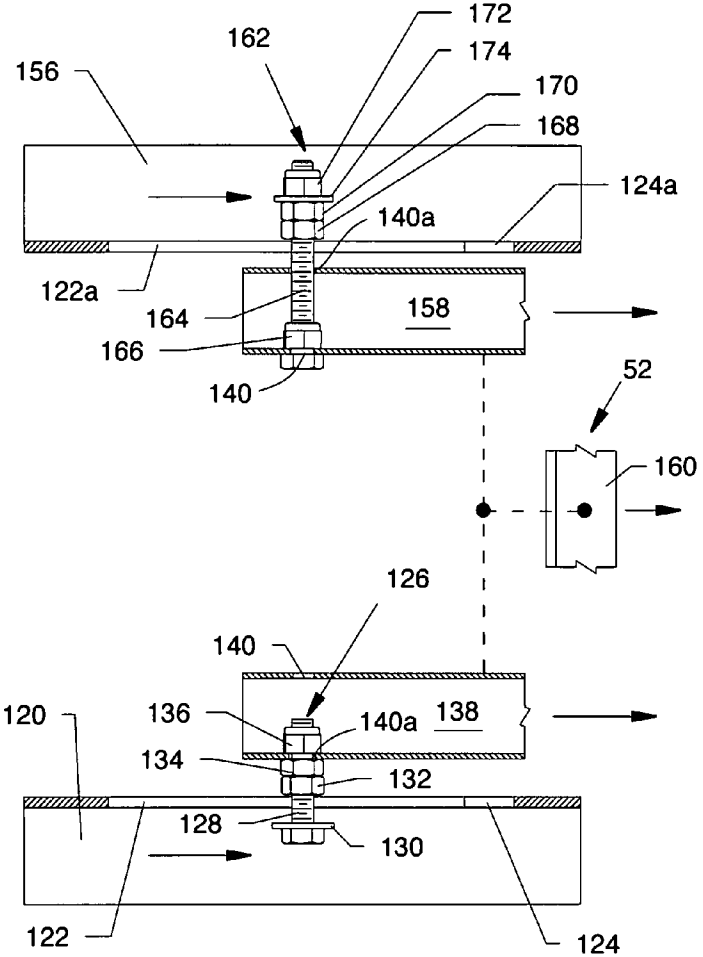

FIG. 11 is a foreshortened isometric view of the door stop assembly 52 used to lock the face panel door 36*a* or others of such doors in the open position, such as illustrated in FIG. 12. Also shown are the top and bottom pivot brackets 64 and 66, respectively, which are part of the face panel door 36*a*. A bottom slotted track channel 120 is secured within a portion of the bottom channel 12*d* of the frame 12 and includes a diagonally oriented slot 122 on the main panel of the track channel 120 which slot 122 intersects and communicates with an arcuate catch 124 located in the main panel wherein the diameter of the arcuate catch 124 is larger than the short dimension across the slot 122. A bottom latch 126 is an assembly that includes a bolt 128, a washer 130, and nuts 132, 134 and 136 and is arranged, as shown in FIGS. 14*a* and 14*b*, to slidingly communicate with the slot 122 or the arcuate catch 124. A bottom cross bar link 138 in the form of a box tube includes a hole set 140; i.e. opposed body holes 140 and 140*a* on the top and bottom panels of the cross bar link for the purpose of reversibility for multiple use at one end where the body hole 140*a* accommodates the upper end of the bottom latch 126, as shown FIGS. 14*a* and 14*b*. Additionally, the opposite end of the bottom cross bar link 138 includes an access hole 142 on the top panel and an opposed body hole 144 for accommodation of a bottom pivot assembly 146 which includes a bolt 148, a washer 150, and a nut 152. The bolt 148 is also accommodated by a hole 154 in the pivot bracket 66, the latter of which is secured to the bottom channel 12*d* of the frame 12. Correspondingly, a top slotted channel 156 and a top cross bar link 158 are mirror images of the bottom slotted track channel 120 and of the bottom cross bar link 138, respectively. The top cross link bar 158 and the bottom cross bar link 138 are connected by a positionable link bar handle 160 which can be angle stock, tube stock or any other suitable geometric configuration suitably secured therebetween. A top latch 162 which is an assembly of a bolt 164, nuts 166, 168 and 170, and a washer 174 is accommodated by the top slotted channel 156 and by the top cross link bar 158 as shown in FIGS. 14*a* and 14*b*. The top pivot assembly 176, which is like the bottom pivot assembly 146, includes a like numbered bolt 148, washer 150, and nut 152, such as used in the bottom pivot assembly 146, and is accommodated by the body hole 144 in the top of cross bar link 158 and by a hole 178 in the top pivot bracket 64, the latter of which is secured to the top channel 12*a* of the frame 12.

MODE OF OPERATION

FIG. 12 illustrates the door stop assembly 52 in use to hold the face panel door 36*a* in the open position. Illustrated, in particular, is the relationship of the bottom cross bar link 138 which slidingly connect the bottom slotted track channel 120 in the bottom channel 12*d* of the frame 12 to the face panel door 36*a*. Such a relationship is also incorporated involving the top cross bar link 158 which slidingly connects the top slotted track channel 156 (FIG. 11) in the top channel 12*a* of the frame 12 to the face panel door 36*a*.

FIG. 13 is a top view of the face panel doors 36*a*, 36*b* and a portion of the face panel door 36*c* secured to the frame 12 where the face panel door 36*a* is in the open and locked position and where the face panel doors 36*b* and 36*c* are in the closed and locked position, thereby illustrating the open mode and the closed mode with respect to the positioning of the face panel doors 36*a*-36*n*. In this view, the top channel 12*a* is removed and the top panel 60 of the face panel doors 36*b* and 36*c* are removed to reveal the structure therebeneath. The parallelogram profile shape of the face panel doors 36*a*-36*n* is evident with reference to the face panel door 36*a* where the top panel 60 (and 62) is in the shape of a parallelogram, thereby imparting an angular relationship with the side panels 56 and 58 also shown in FIG. 6. As shown in the closed and locked mode, the seal 70 of the face panel door 36*b* is in close and intimate sealing minimally distorted contact with the upper and lower portions of the continuous lip 13 and with the formed channel 14*b* and 14*a*. The closed face panel door 36*b* is fixed and secured in the closed position at one edge by the top hinge bracket assembly 38*b* in vertical alignment with the bottom hinge bracket assembly 40*b* and also along the top by the locking of the top latch assembly 42*b* to the top latch assembly 46*b* (not shown), as well as along the bottom by the locking of the bottom latch assembly 44*b* (FIG. 2) to the bottom latch assembly 48*b*. The close fit of the face panel doors 36*a*-36*n* is demonstrated where the angled side panel 58 of the face panel door 36*b* is in very close parallel proximity to the angled side panel 56 of the face panel door 36*c*, whereby the respective vertical edge regions of the adjacent face panels 54 of the face panel door 36*b* and 36*c* are also in very close parallel proximity to provide nearly gapless alignment to allow smooth and continuous uninterrupted viewing of the LED pixels located on the plurality LED of display modules 68. Such a relationship is employed along and about the adjacent face panel doors when 36*a*-36*n* are in the closed position.

Positioning of the door stop assemblies 52 is also shown in FIG. 13. As shown with respect to the closed and locked face panel door 36*b*, the top latch 162 is positioned to the left end of the slot 122*a* of the top slotted channel 156, whereby the door stop assembly 52 is stowed and hidden from view. The same relationship occurs with respect to the bottom latch 126 which is positioned to the left end of the slot 122 of the bottom slotted channel 120. As shown with respect to the open and locked face panel door 36*a*, the top latch 162 is positioned beyond the right end of the slot 122*a* of the top slotted channel 156 and in engagement with the arcuate catch 124*a*, whereby the door stop assembly 52 is locked in the open position. The same relationship occurs with respect to the bottom latch 126 which is positioned beyond the right end of the slot 122 of the bottom slotted channel 120 in engagement with the arcuate catch 124. Positioning of the face panel door 36*a* to the open position is accomplished by disengaging the top and bottom latch assemblies 42*a* and 44*a* from the top and bottom catch assemblies 46*a* and 48*a* and then urging the link bar handle 160 to reposition the top and bottom latches 162 and 126 along the top and bottom slotted channels 156 and 120, such as shown in FIGS. 14*a* and 14*b*.

FIGS. 14*a* and 14*b* illustrate the operation of the door stop assembly 52 and the relationship of the top latch 162 and the top cross bar link 158 to the slot 122*a* and arcuate latch 124*a* of the top slotted channel 156, as well as the relationship of the bottom latch 126 and the bottom cross bar link 138 to the slot 122 and arcuate latch 124 of the bottom slotted channel 120.

FIG. 14*a* shows the in transit position from a closed position of components of the door stop assembly 52 from the closed and locked position to the open and locked position, as shown in FIG. 14*b*. In FIG. 14*a*, the bolt 164 of the top latch 162 is held securely within the hole 140 of the top cross bar link 158 by the nut 166 and extends through the hole 140*a* and thence through and beyond the slot 122*a*. Nuts 168 and 170 are arranged in double nutted fashion and jammed together in frictional engagement and at a fixed position along and about the shaft of the bolt 164 at a position which allows the nut 168 to intimately and supportingly and to slidingly engage the upper surface of the material surrounding the slot 122*a* in order to suspendingly support one end of the top cross bar link 158 with respect to the top slotted channel 156. In a related fashion, the bolt 128 of the bottom latch 126 is held securely within the hole 140*a* of the bottom cross bar link 138 by the nut 136 and the nut 134. The nut 132 aligns to the nut 134 in double nutted fashion and jammed together therewith in frictional engagement and at a fixed position along and about the shaft of the bolt 128. The bolt 128 extends through and beyond the slot 122. Nuts 132, 134 and 136 are arranged in a fixed position along and about the shaft of the bolt 128 at a position which allows the nut 132 to intimately and supportingly and to slidingly engage the upper surface of the material surrounding the slot 122 in order to support one end of the bottom bar link 138 with respect to the bottom slotted channel 120. The link bar handle 160 is urged in a suitable direction, such as indicated, to cause the top latch 162 to slide along the slot 122*a* and to cause the bottom latch 126 to slide along the slot 122, while at the same time, urging the top pivot 176 and the bottom pivot 146 (FIG. 11) at the opposite end of the top cross bar link 158 and the bottom cross bar link 138, respectively, to impart an opening force to rotate the face panel door 36*a* about the top and bottom hinge bracket assemblies 38*a* and 40*a*.

The door stop assembly 52 is actuated further to the locking position with gravity assisting the locking process when intimate contact of the nut 168 of the top latch 162 with slot 122*a* is discontinued, whereby the nut 168 and 170 of the top latch 162 descend along the arcuate catch 124*a*. Such descent is stopped by the washer 174 which engages the material surrounding the arcuate catch 124*a* whereby the nut 170 lockingly engages the arcuate catch 124*a* and is further prevented from entry into the slot 122*a*. Thus, the top cross bar link 158 is locked in position. With respect to the bottom latch 126 and associated components thereof, intimate contact of the nut 132 of the bottom latch 126 with slot 122 is discontinued when the nut 132 and 134 of the bottom latch 126 descend into the arcuate catch 124. Such descent is stopped by engagement of the bottom panel of the bottom crossbar link 138 with the top surface of the bottom slotted track channel 120 when the nut 134 lockingly engages the arcuate catch 124 and is further prevented from entry into the slot 122. Thus, the bottom cross bar link 138 is locked in position. Unlocking is accomplished by urging the link bar handle 160 upwardly to vertically position the top and bottom crossbar links 158 and 138 to disengage the nuts 170 and 134 from the arcuate catches 124*a* and 124, respectively, as well as positioning the nuts 168 and 132 for subsequent horizontal sliding and repositioning along the material surrounding the slots 122*a* and 122 upon leftward horizontal positioning of the link bar handle 160. Such vertical and/or horizontal positioning is limited by contact of the washer 130 of the bottom latch 126 with the underside of the material surrounding the slot 122 or by contact with the underside of the material surrounding the arcuate catch 124 and by contact of the top surface of the top cross bar link 158 with the bottom surface of the top slotted channel 156. When the link bar handle 160 has been actuated fully to the left in order to reposition the top and bottom cross bar links 158 and 138 to accomplish closing of the face channel door 36*a*, the top and bottom latch assemblies 42*a* and 44*a* can then be actuated to lockingly engage the top and bottom catch assemblies 46*a* and 48*a*, respectively, thereby securing the face panel door 36*a* in the locked position.

It is claimed:

1. An electronic sign comprising:

a frame means;

a plurality of vertically hinged face panel doors;

a plurality of offset hinge means securing each of said vertically hinged face panel doors to said frame means;

a door stop means attached between each of said plurality of vertically hinged face panel doors and said frame means;

a captivated bolt door latch secured to at least one upper and lower front regions of each of said plurality of vertically hinged face panel doors;

a door catch, opposite said captivated bolt door latch, secured to at least one upper and lower front regions of said frame means; and, a plurality of light display modules supported within each of said face panel doors;

wherein said frame means has top and bottom, elongated, opposed channels and left and right, elongated, opposed side channels, said channels being joined together to form a rigid rectangular frame, and wherein each of said plurality of face panel doors has a front face panel with top and bottom, elongated, opposed flanges and left and right, elongated, opposed flanges, said front face panel and said flanges being joined together to form said face panel door and said front face panel has a plurality of apertures therein.

2. The electronic sign of claim 1, wherein said light display modules are LED modules.

3. The electronic sign of claim 1, wherein each of said left and right opposed flanges of each of said face panel doors has angled surfaces.

4. The electronic sign of claim 3, wherein said frame has a continuous lip extending around and attached to a peripheral front portion of said rigid rectangular frame, said continuous lip having a bottom leg attached to and around said peripheral front portion of said rigid rectangular frame and a top leg extending away from said rigid rectangular frame at a 90 degree angle.

5. The electronic sign of claim 4, wherein a rectangular panel, with an open central area of substantially the size defined by the perimeter of said rigid rectangular frame, is attached to said continuous lip.

6. The electronic sign of claim 5, wherein each of said face panel doors is movably attached to said bottom leg of said continuous lip and said rigid rectangular frame by a pair of said offset hinge means, each of said offset hinge means being pivotally attached to an upper corner and to a bottom corner of each of said face panel doors.

7. The electronic sign of claim 6, wherein each of said offset hinge means includes a first hinge bracket attached to said upper corner and to said lower corner of each of said face panel doors and a second hinge bracket attached to each of said first hinge brackets by a pivotal assembly and to said bottom leg of said continuous lip and said rigid rectangular frame.

8. The electronic sign of claim 7, wherein said door stop means is an assembly including a top slidable cross bar link and a bottom slidable cross bar link, each cross bar link being connected between each of said face panel doors and said rigid rectangular frame.

9. The electronic sign of claim 7, wherein said door stop means includes an upper assembly and a lower assembly connected between the upper and lower regions of each of said face panel doors and the upper and lower regions of said rigid rectangular frame.

10. The electronic sign of claim 9, wherein each of said upper and lower door stop assemblies includes a crossbar link pivotally attached to an inner surface of said top flange in the top corner of each of said face panel doors and to an inner surface of said bottom flange in the bottom corner of each of said face panel doors, a top slotted channel and a bottom slotted channel attached respectively to said top and bottom, elongated, opposed channels of said rigid rectangular frame, said slot in each of said top and bottom slotted channels extending diagonally from east to west on a top surface of each of said top and bottom slotted channels, a catch in the form of a circular hole at the eastern end of said slot, said circular hole having a diameter slightly larger than the width of said slot, a nut and bolt assembly fixedly attached to each of said crossbar links at an end thereof opposite said pivotally attached end to each of said face panel doors, said bolt of said nut and bolt assembly being slidably movable within said slot and latchable within said circular hole, and an elongated link bar handle being fixedly attached to each of said crossbar links.

11. The electronic sign of claim 10, wherein said electronic sign includes a pair of said captivated bolt door latches for each of said panel doors, one of said captivated bolt door latches being spaced from said first hinge bracket and secured to said upper front region of each of said face panel doors and another of said captivated bolt door latches being spaced from said second hinge bracket and secured to said lower front region of each of said face panel doors, each of said captivated bolt door latches extending slightly beyond the top and bottom edges of said face panel door and wherein said electronic sign includes a pair of door catches, each of said door catches being secured to said top leg of said continuous lip and in alignment with each of said extended portions of said captivated bolt door latches, and each of said extended portions of said captivated bolt latches having a bolt fastener in alignment with a hole in each of said door catches.

12. The electronic sign of claim 11, wherein said electronic sign includes a plurality of spaced, elongated, formed channels secured to said top and bottom, elongated opposed channels of said rigid rectangular frame.

13. The electronic sign of claim 12, wherein said electronic sign includes a plurality of spaced mounting supports secured externally to said left and right, elongated, opposed side channels of said rigid rectangular frame.

14. The electronic sign of claim 1, wherein each of said face panel doors has at least one elongated spaced element secured to said top and bottom, elongated, opposed flanges of each of said face panel doors.

15. The electronic sign of claim 1, wherein each of said face panel doors is rectangular in shape and has an inner peripheral lip parallel to said front face panel and a sealing element secured to an outer surface of said inner peripheral lip on each of said face panel doors.

16. The electronic sign of claim 15, wherein said sealing element is made from foam, soft rubber or plastic.

17. The electronic sign of claim 1, wherein each of said face panel doors has a polycarbonate sheet secured to the rear surface of said front face panel of said face panel door.

18. The electronic sign of claim 17, wherein said polycarbonate sheet is clear or transparent.

19. The electronic sign of claim 17, wherein said plurality of light display modules are secured within each of said face panel doors and behind said polycarbonate sheet.

20. An electronic sign comprising a rigid rectangular frame, a plurality of face panel doors vertically and pivotally attached to said rigid rectangular frame, each of said face panel doors having a front face panel with a plurality of apertures therein, each of said face panel doors having top and bottom flanges and left and right side flanges, said front face panel and flanges forming said face panel door, each of said face panel doors having opposed offset hinge means secured between said top and bottom flanges and said rigid rectangular frame, each of said offset hinge means having a pivotal mechanism such that each face panel door can swing away from and towards said rigid rectangular frame, a plurality of light display modules being secured within each of said plurality of face panel doors and positioned behind said front face panel.

21. The electronic sign of claim 20 wherein said light display modules are LED modules.

22. The electronic sign of claim 20, including a door stop means attached between each of said plurality of face panel doors and said rigid rectangular frame for limiting the distance said face panel door can swing away from said rigid rectangular frame.

23. The electronic sign of claim 22, wherein a captivated bolt latch is secured to at least one upper and lower front regions of each of said face panel doors and wherein a door catch is secured to at least one upper and lower front regions of said rigid rectangular frame, said captivated bolt latch on said face panel door being in alignment with said door catch on said rigid rectangular frame such that when said face panel door is in a closed condition said face panel door is maintained closed due to the mutual engagement between said bolt latch and said door catch.

* * * * *